US005539361A

United States Patent [19]

Davidovitz

[11] Patent Number: 5,539,361

[45] Date of Patent: Jul. 23, 1996

[54] ELECTROMAGNETIC WAVE TRANSFER

[75] Inventor: Marat Davidovitz, Waltham, Mass.

[73] Assignee: The United States of America as represented by the Secretary of the Air Force, Washington, D.C.

[21] Appl. No.: 455,578

[22] Filed: May 31, 1995

[51] Int. Cl.[6] ..... H01P 5/107

[52] U.S. Cl. ..... 333/26; 333/34

[58] Field of Search ..... 333/26, 34, 21 R

[56] References Cited

U.S. PATENT DOCUMENTS

| | | | |
|---|---|---|---|
| 3,995,239 | 11/1976 | Head et al. | 333/26 X |
| 4,562,416 | 12/1985 | Sedivec | 333/26 |
| 4,608,713 | 8/1986 | Shiomi et al. | 333/26 |
| 4,803,446 | 2/1989 | Watanabe et al. | 333/26 |
| 5,414,394 | 5/1995 | Gamand et al. | 333/26 |

FOREIGN PATENT DOCUMENTS

| | | | |
|---|---|---|---|
| 109702 | 4/1992 | Japan | 333/26 |

*Primary Examiner*—Paul Gensler
*Attorney, Agent, or Firm*—William G. Auton

[57] ABSTRACT

Method and apparatus for transiting from one form of electromagnetic wave guidance to another by increasingly or reducingly guiding an electromagnetic wave to or from a conductor serving as a ground plane and coupled to the other form of wave guidance at the ground plane through an aperture, where wave guidance can be by a waveguide, planar line or coaxial cable and to or from a planar line that is transversely disposed in relation to wave guidance thereto or therefrom.

3 Claims, 7 Drawing Sheets

ELECTROMAGNETIC WAVE TRANSFER

BACKGROUND OF THE INVENTION

This invention relates to electromagnetic wave guidance by devices such as waveguides, planar lines and coaxial cables, and more particularly to the transfer of electromagnetic energy among such devices.

A waveguide is formed by a solid dielectric rod or a dielectric filled tubular conductor capable of guiding electromagnetic waves. A planar line for guiding electromagnetic waves generally takes the form of an extended, narrow member of uniform width which is commonly designated as a microstrip line when the strip is insulated from a single ground plane by a dielectric, and is known as an ordinary strip line when the strip is interposed in a dielectric between ground planes. A coaxial cable guides electromagnetic waves between an elongated inner conductor and an outer conductor that is spaced from and encloses the inner conductor.

Many microwave and millimeter wave systems employ waveguides, planar lines and coaxial cables in conjunction with antennas, high-Q (low loss) filters and oscillators, and nonreciprocal components, such as circulators. The signals from such waveguides are often used in hybrid and monolithic integrated circuits, which generally are of planar construction and cannot receive waveguide energy directly. Consequently a transition must be made from one electrical mode, i.e. pattern of electrical wave motion, to another.

For example, if waveguide energy is in the Transverse Electric (TE) mode in a rectangular waveguide, which is a tubular conductor having a rectangular cross-section, the electric field strength has a sinusoidal distribution across the longer cross-sectional dimension of the guide. If this energy is to be used in a monolithic circuit a transition must be made to the Transverse ElectroMagnetic (TEM) mode, where the electromagnetic field pattern is like that of any ordinary transmission line.

A suitable transition can be made from the waveguide to a planar line or coaxial cable. Conversely, if energy is to be received by a waveguide from a planar line or coaxial cable, the transition is made to the waveguide.

Since a coaxial cable has an inner conductor surrounded by a grounded cylinder, which serves as a reference conductor, and a planar line is formed by a flat, elongated conductor mounted above a ground or reference conduction plane, or between ground planes, a planar line approximates a flattened coaxial line which may have a dielectric fill other than air.

When planar lines are used with wave guides, wave energy must be coupled between the planar line and the associated wave guide. Prior art techniques for coupling striplines to wave guides are illustrated in the following U.S. Patents, the disclosures of which are herein incorporated by reference: U.S. Pat. No. 3,483,489 to Dietrich; U.S. Pat. No. 3,579,149 to Ramsey; U.S. Pat. No. 3,732,508 to Ito et al; U.S. Pat. No. 3,755,759 to Cohn; U.S. Pat. No. 3,882,396 to Schneider; U.S. Pat. No. 3,969,691 to Saul; U.S. Pat. No. 4,143,342 to Cain et al and U.S. Pat. No. 4,754,239 to Sedivec.

All of the foregoing references, except Sedivec, provide transformation between the TE and TEM modes relying on coaxial lines, and are not effective at frequencies greater than 40 GigaHerz (GHz) because of the generation of undesirable TE and TM modes as a result of tolerance and size requirements.

While Sedivec provides a suitable wave guide to stripline transition, it requires a tapered wedge that is mounted behind a movable wall within a wave guide. Since the wall is a reflecting panel, it must be moved to a suitable position in order to accomplish the desired transition with a suitable standing wave ratio.

Other transitions are of the probe type as disclosed by T. Q. Hi and Y. Shoe in "Spectral-domain analysis of E-plane waveguide to microstrip transitions", IEEE Trans. Microwave Theory Tech, vol 37 pp 388–392, Feb. 1989 and J. Machac and W. Menzel, "On the design of waveguide to microstrip and waveguide to coplanar line transitions", 23rd European Microwave Conf., 1993 Madrid Spain, pp 615–616. However, probe transitions generally are undesirable because their structures are complex and they are difficult to seal hermetically.

Transition can also be made using an antipodal finline, where wave guidance is along a narrow channel between coplanar conductors, as discussed in L. J. Lavedan, "Design of waveguide to microstrip transitions specially suited to millimeter—wave application", Electron Lett, vol 13, Sept 1977. Once again suitable hermetic sealing is a problem.

Although a ridged waveguide transition can be used of the kind discussed in W. Menzel and A. Klassen, "On the transition from ridge waveguide to microstrip", Proc. 19th European Microwave Conf., 19898, pp. 1265–1269, again there are mechanical complexities and difficulties in achieving a hermetic seal.

The foregoing transitions also have the objection that they are not simple and compact, and easily integrable with planar circuits. The metal structure of Menzel and Klassen, for example, extends to both sides of the planar substrate and the planar substrate has to be cut to a specific form. Hermetic seal is difficult because a split-block is required for the waveguide mounting.

Another waveguide to microstrip transition module is disclosed in U.S. Pat. No. 5,202,648 which issued to J. H. McCandless on Apr. 13, 1993. The module is an assembly of a base connected to a waveguide and a circuit board, with one side of the board mounted on the base. The other side of the circuit board includes a microstrip that has an associated backshort and a metallic cup bonded to the base and circuit board. This configuration is mechanically and electrically complex and does not achieve suitable power transfer.

Still another microstrip to waveguide transition is disclosed in 42 IEEE Transactions on Microwave Theory and Techniques 1842 and 1843, No. 9, September 1994, by Wilfried Grabherr et al. A slot coupled antenna that radiates into a waveguide requires an internal substrate within the waveguide, desirably at a step transition within the waveguide.

Accordingly, it is an object of the invention to achieve an efficient transition among wave guides, planar lines and coaxial cable. Another object is to provide effective transformation between modes at extra high frequencies (EHF).

A further object of the invention is to provide a simpler transition than is commonly provided by transitions of the probe type, or transitions using antipodal fin lines and ridges within waveguides.

Another object is to achieve transitions which provide effective transformation between modes at extra high frequencies (EHF), and yet are wide-banded.

A still further object is to facilitate hermetic sealing when there is a transition between modes of wave guidance. A related object is to avoid the objections that commonly attend probe transitions between planar lines and waveguides.

Still another object is achieve transitions which can cover the full spectrum of microwave to millimeter wave wave guidance. A related object is to achieve suitable transitions from the band of 8.2 to 12.4 GHz, up to 100 GHz.

SUMMARY OF THE INVENTION

In accomplishing the foregoing and related objects the invention provides apparatus for transiting from one form of electromagnetic wave guidance to another by reducingly guiding an electromagnetic wave to, or increasingly guiding the wave from, a conductor serving as a ground plane, where there is coupling to another form of wave guidance at the ground plane through an aperture.

In accordance with one aspect of the invention the guidance is by a waveguide, which can be rectangular in cross-section, and the coupling can be to a planar line angularly disposed, for example, transversely, with respect to the waveguide.

In accordance with another aspect of the invention, the planar line is insulated from the ground plane and energy is transmitted to or from the planar line though an aperture in the ground plane. The aperture in the ground plane is geometrically similar to any guide aperture that abuts the ground plane, and desirably is confined within the boundaries any guide aperture abutting the ground plane.

In accordance with a further aspect of the invention, the waveguide reducingly guides electromagnetic energy by being tapered from a standard input opening to a narrower output opening at a ground plane, with the taper being configured to eliminate reflections from the ground plane. Conversely, when the input is at the narrower opening, the electromagnetic energy in increasingly guided to the opening when then serves as an output.

In a transition assembly for coupling a wave guide to a planar line through an apertured ground plane from which the planar line is insulated by a dielectric, a waveguide section is affixed to the ground plane at the aperture and internally tapered from a standard opening to a narrower opening corresponding to the aperture at the ground plane. This form of attachment provides hermetic sealing of the guide to the line.

The internally tapered wave guide of the invention can include a dielectric wedge that extends inwardly with its base at the narrow guide opening in order to permit more efficient power transfer and a narrower coupling aperture. The length of the wedge depends upon the dielectric constant of the material from which it is made.

In a method of transiting from one form of electromagnetic wave guidance to another, the steps include reducingly guiding an electromagnetic wave to, or increasingly guiding a wave from, a conductor serving as a ground plane and coupling to the other form of wave guidance at the ground plane. The guidance can be of an electromagnetic wave along a waveguide.

In a method of fabricating a transition from one form of electromagnetic wave guidance to another, the steps include providing for reducingly or increasingly guiding an electromagnetic wave; affixing the guiding structure to a conductor serving as a ground plane; and coupling the ground plane to the other form of wave guidance. The coupling can be by disposing a strip line transversely with respect to the guiding structure, and the strip line can be insulated from the ground plane, with energy transmitted to the strip line though an aperture in the ground plane.

The energy desirably is transmitted through an aperture in the ground plane geometrically similar to any guide aperture abutting the ground plane, with the aperture in the ground plane confined within the boundaries of any waveguide aperture abutting the ground plane, and the waveguide reducingly guides electromagnetic energy by being tapered from a standard input opening to a narrower output opening at the ground plane, with the taper being configured to eliminate reflections from the ground plane.

DESCRIPTION OF THE DRAWINGS

Other aspects of the invention will become apparent after considering several illustrative embodiments, taken in conjunction with the drawings in which.

DETAILED DESCRIPTION

The invention provides for the transfer of energy among waveguides, planar lines and coaxial cables, for example by a transition for coupling signals from a rectangular wave guide to a microstripline at frequencies in the Gigahertz (GHz) range, approaching EHF (greater than 40 GHz).

Figure 1A:
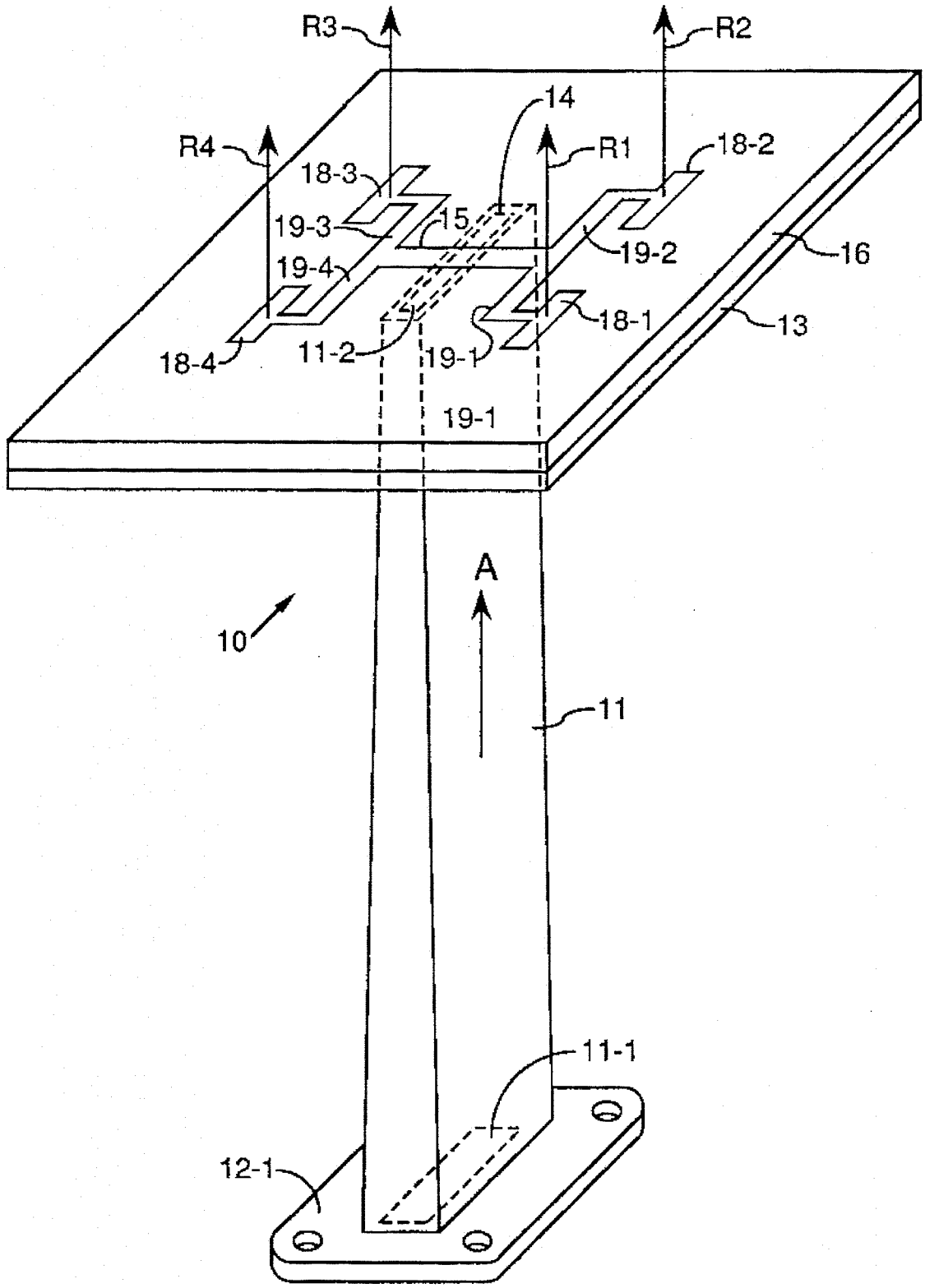
FIG. 1A is a perspective view of a transmission system including a waveguide to microstripline transition in accordance with the invention.

With reference to FIG. 1A, a transition 10 for waveguide to microstrip line transfer in accordance with the invention is provided by a tapered waveguide section 11 and a microstripline 15 that is transverse to the axis A of propagation along the guide section 11.

The waveguide 11 of FIG. 1A is intended to operate in the TE10 mode, but other waveguide structures and operating modes may be used. The waveguide 11 is connected to other waveguide components (not shown) in standard fashion at a flange 12-1.

The waveguide section 11 is internally tapered from a standard-sized opening 11-1 to a reduced-sized opening 11-2 which abuts and is hermetically sealed to a conductive sheet 13 that serves as a "ground", i.e. voltage reference, plane, and is attached, e.g. by metallic vapor deposition, to an insulating substrate 16.

In order to transmit waveguide energy, the ground plane 13 contains an aperture 14, which is generally similar to and smaller than, or equal to, the reduced-sized waveguide opening 11-2, which becomes enlarged along the length of the guide section 11 towards the flange 12-1 until the opening is standard-sized for accommodating any additional length of wave guide that is to be secured to the flange 12-1.

When energy is transmitted to the antenna, or other circuit elements, it reducingly travels along the waveguide 11. Conversely, when energy is received by an antenna, or generated in a circuit, it increasingly travels along the waveguide 11.

It will be appreciated that the attachment of the waveguide section 11 to the ground plane 13 may be made in any convenient fashion. Similarly, any convenient attachment to the strip line 15 may be made. In FIG. 1A the strip line 15 extends to patch antennae 18-1 through 18-4 by line extensions 19-1 through 19-4 from the microstrip line 15. The patch antennae 18-1 through 18-4 radiate in the directions indicated by the arrows R1–R4 after receiving microwave energy at GigaHertz frequencies from the connecting waveguide. The arrangement of FIG. 1A, which splits the signal received from the waveguide permits transmission and reception with respect to two different sets of patch antennae, connected to the respective ends of the microstrip line 15.

Figure 1B:
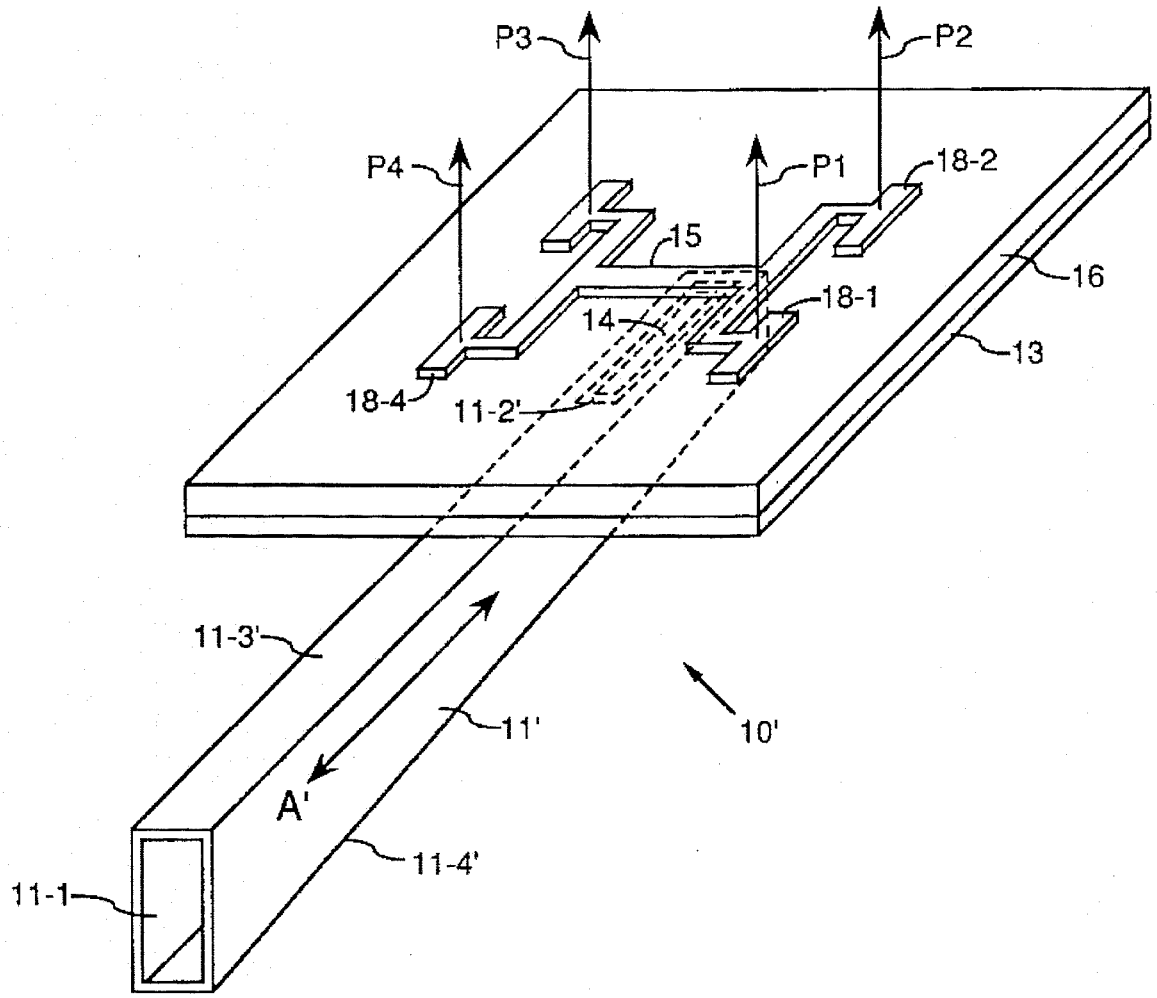
FIG. 1B is a perspective view of an alternative transmission system including a waveguide to microstripline transition in accordance with the invention.

While the laminate formed by ground plane 15 and the dielectric 16 is mounted perpendicularly with respect to the waveguide axis A, compactness is achieved by the horizontal mounting shown for the transition 10' in FIG. 1B. However, instead of having the reduced size opening 11-2' at the end of the waveguide section 11', it is in a side wall 11-3' as shown In addition the guide cross-section is asymmetric so that the apertured wall 11-3' of the guide section 11' can be horizontally positioned. For that purpose, the side wall 11-3' is perpendicular to the input opening 11-1, while the opposing side wall 11-4' is tapered towards the the upper side wall 11-3'. Since the output opening 11-2' is in the upper wall, the end of the section 11' is closed and is positioned at a distance from the opening 11-2' that provides suitable impedance matching for energy transmitted or received in the direction of the double-headed arrow A'. In both FIGS. 1A and 1B the walls of the respective guide section 11 and 11' have uniform thickness, so that they have an externally tapered appearance, as well as internal tapering.

Figures 2A, 2B:
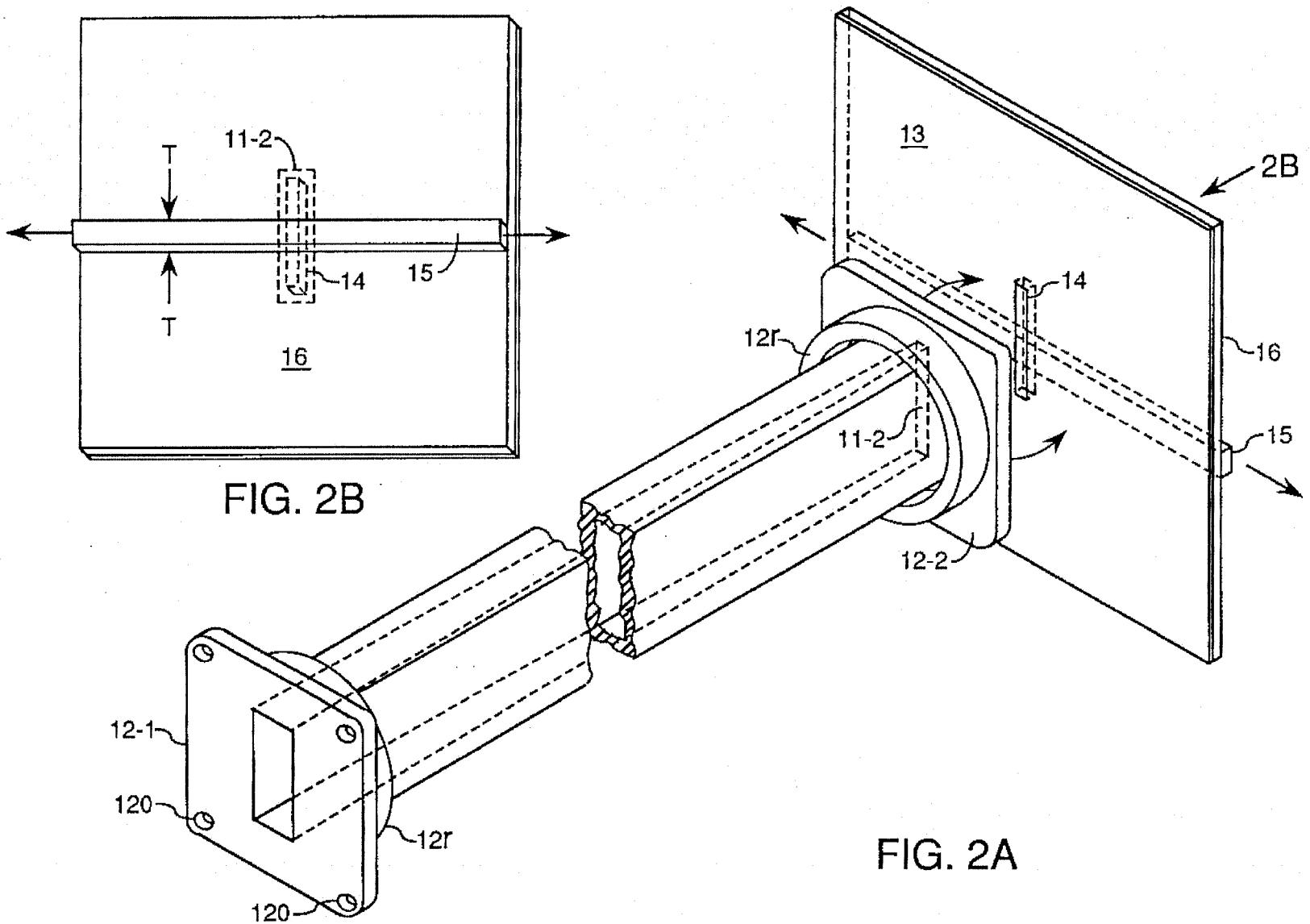
FIG. 2A is an exploded perspective view of a waveguide to stripline transition in accordance with the invention.
FIG. 2B is a rear view taken in the direction of the arrow B—B of FIG. 2A.

The guide section of the waveguide also can have a standard rectangular exterior as shown in FIG. 2A terminated in flanges 12-1 and 12-2, which include reinforcement rings 12*r*. The flange 12-1 has openings 12*o* by which it can be connected in standard fashion to other waveguide components.

As indicated in FIG. 2B, which is a rear view taken in the direction of the arrow B—B of FIG. 2A, the strip line 15 extends across the insulating substrate 16, which serves as a dielectric, into contact with other components, such as the patch antennae of FIGS. 1A and 1B and other circuit elements.

The arrangements of FIGS. 1A and 1B divide the energy from the waveguide equally between the two ends of the line 15. It will be appreciated that the feed need not be divided and may be provided to a single terminal by terminating the stripline 15 on the dielectric 16 circuit before the edge of the ground plane 16, e.g. at position T—T of FIG. 2B which has a length from the aperture 14 adjusted to provide suitable impedance matching.

As seen in FIG. 2B, the aperture 14 is similar to, but smaller than, and within the waveguide terminal aperture 11-2.

Figure 2C:
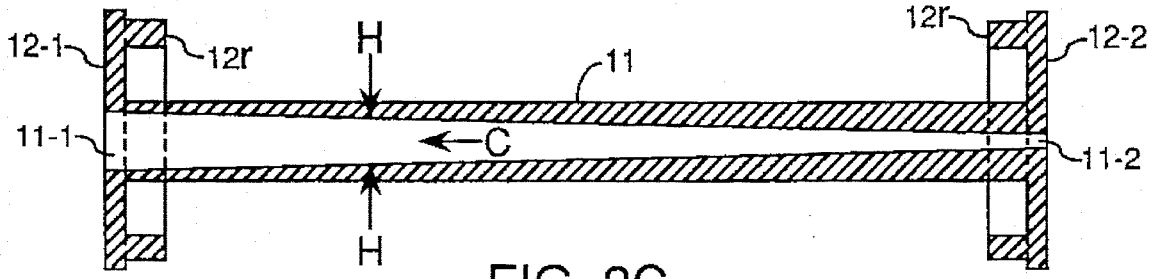
FIG. 2C is a cross-section of FIG. 2A.

In the cross-section of FIG. 2C, taken of FIG. 2A, the internal height of the waveguide 11, illustrated by the arrows H—H increases in the direction of the arrow C. Consequently a wave moves reducingly from the opening 11-1 to the opening 11-2 for the propagation of energy to the stripline 15, and increasingly from the opening 11-2 to the opening 11-1 for the propagation of energy from the stripline 15.

Figure 2D:
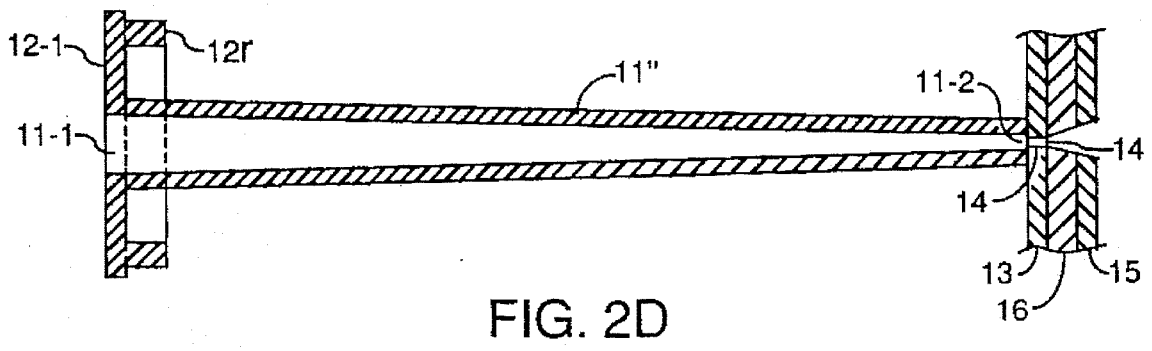
FIG. 2D is a cross-section of an alternate waveguide section with uniform wall thicknesses of FIG. 2A.

In the the alternate cross section of FIG. 2D, the waveguide section 11" has uniformly thick walls and omits the abutting flange at the ground plane 13, so that the walls at the end of the guide section 11' containing the reduced aperture 11-2 are directly connected to the ground plane 13.

Figure 2E:
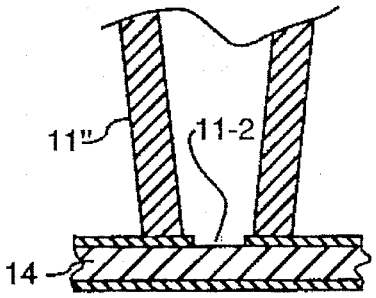
FIG. 2E is an enlarged cross-section of the connection between the waveguide section end of FIG. 2D and the abutting laminate of ground plane, dielectric and microstrip line.

An enlarged cross-section of the connection between the end of the waveguide section end 11" of FIG. 2D, and the abutting laminate of ground plane 13, dielectric 16 and microstrip line 15 is shown in FIG. 2E.

Figure 2F:
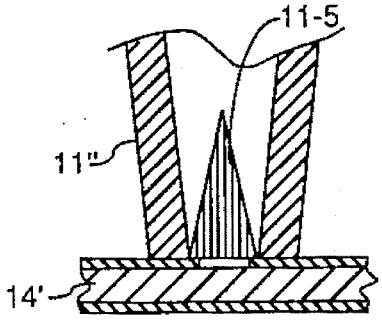
FIG. 2F is an enlarged cross-section showing a modification of FIG. 2E that includes a dielectic stub which permits a narrowing of the ground plane coupling aperture.

An alternate enlarged cross-section in FIG. 2F shows a modification of FIG. 2E that includes a wedge or pyramidally-shaped dielectic stub 11-5 which permits a narrowing of the ground plane coupling aperture 14' as compared with the corresponding aperture 14 in FIG. 2E.

Figure 3A:
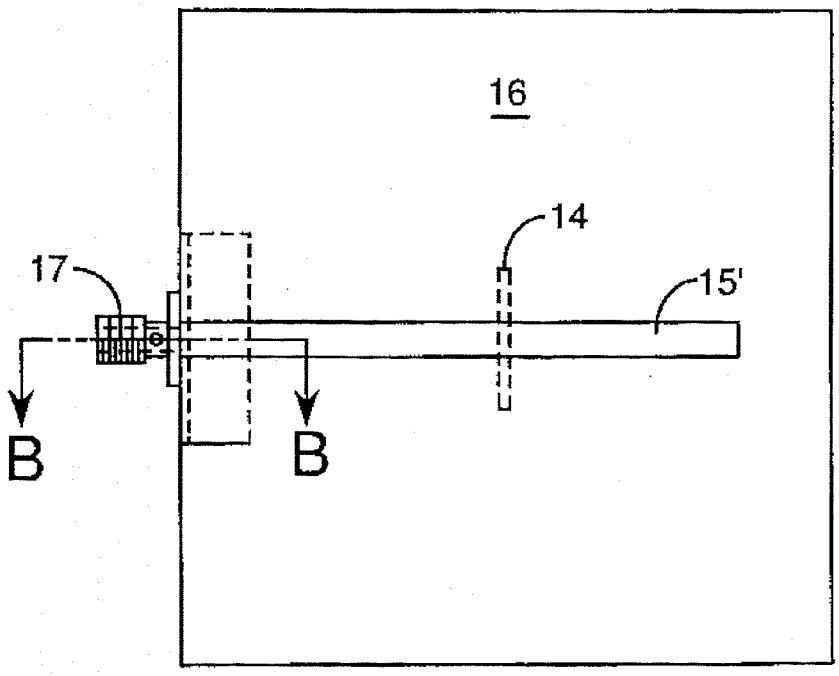
FIG. 3A is a rear view of a ground plane showing a stripline to coaxial cable transition for testing.
Figure 3B:
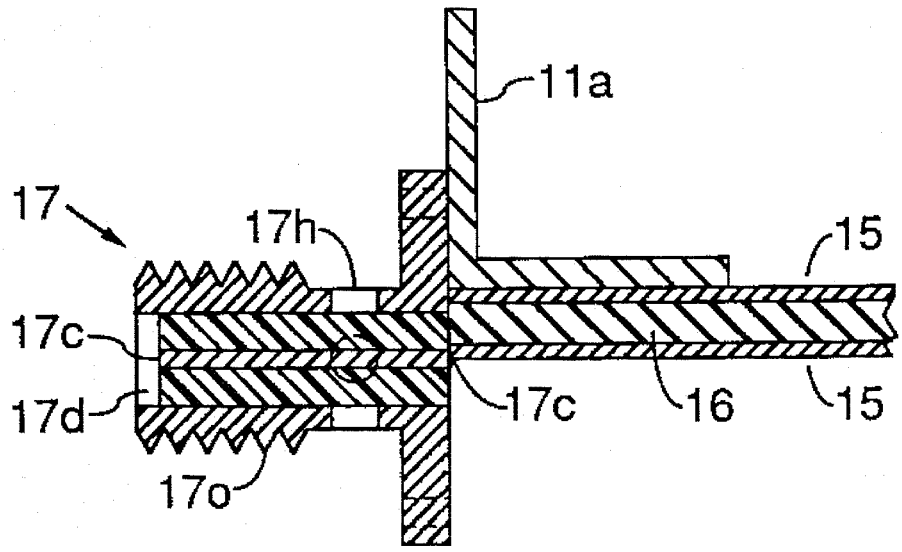
FIG. 3B is a cross-section taken along the lines B—B of FIG. 3A.

In a procedure for testing the transition 10, a coaxial fitting is attached to the ground plane 13 as shown in FIG. 3A, where the microstrip line 15 of FIG. 2B has been modified to provide output only at the fitting 17 and extended beyond the coupling aperture 14 to a length that provides a matching stub 15'. In the sectional view of FIG. 3B, taken along the lines B—B of FIG. 3A the stripline 15 is shown joined to the center conductor 17*c* of the coaxial cable termination 17. The center conductor 17*c* is insulated from the outer conductor 17*o* near the center conductor across hole 17*h* by the dielectric cylinder 17*d*, which is in abutting contact with the ground plane dielectric 16 and waveguide wall section 11*a*. The center conductor 17*c* is joined to the stripline 15, and the fitting 17 can accommodate a standard coaxial cable extension.

Figure 4A:
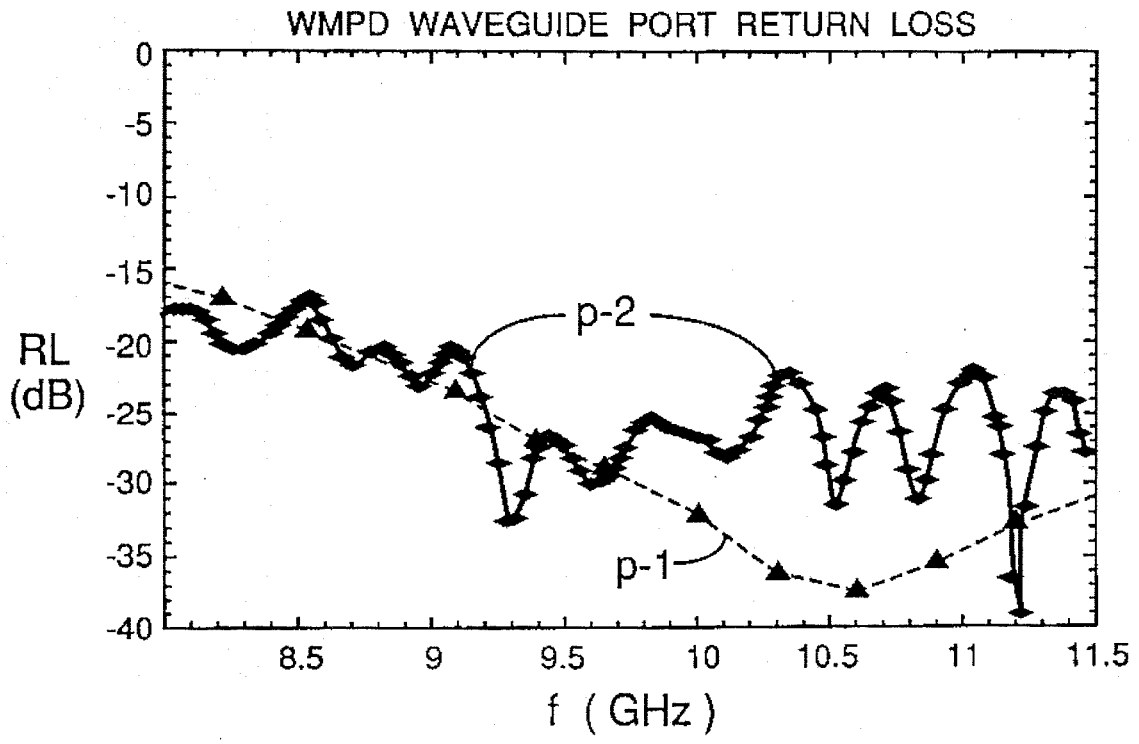
FIG. 4A is a graph of return loss (RL) in decibels (db) plotted against frequency (f) for the waveguide to microstripline transition of FIG. 1A.

FIG. 4A is a graph of illustrative test results showing return loss (RL) in decibels (db) plotted against frequency (f) for the Waveguide to Microstrip Power Divider (WMPD), i.e., waveguide to stripline transition, of FIG. 3A. The plot p-1 provides theoretical results for the transitions, as compared with the plot p-2 showing actual test results. The test results of FIG. 4A are for the X Band in the range from 8.2 to 12.4 GigaHerz, but similar results are obtainable for frequencies up to 100 GHz in discrete bands.

Figure 4B:
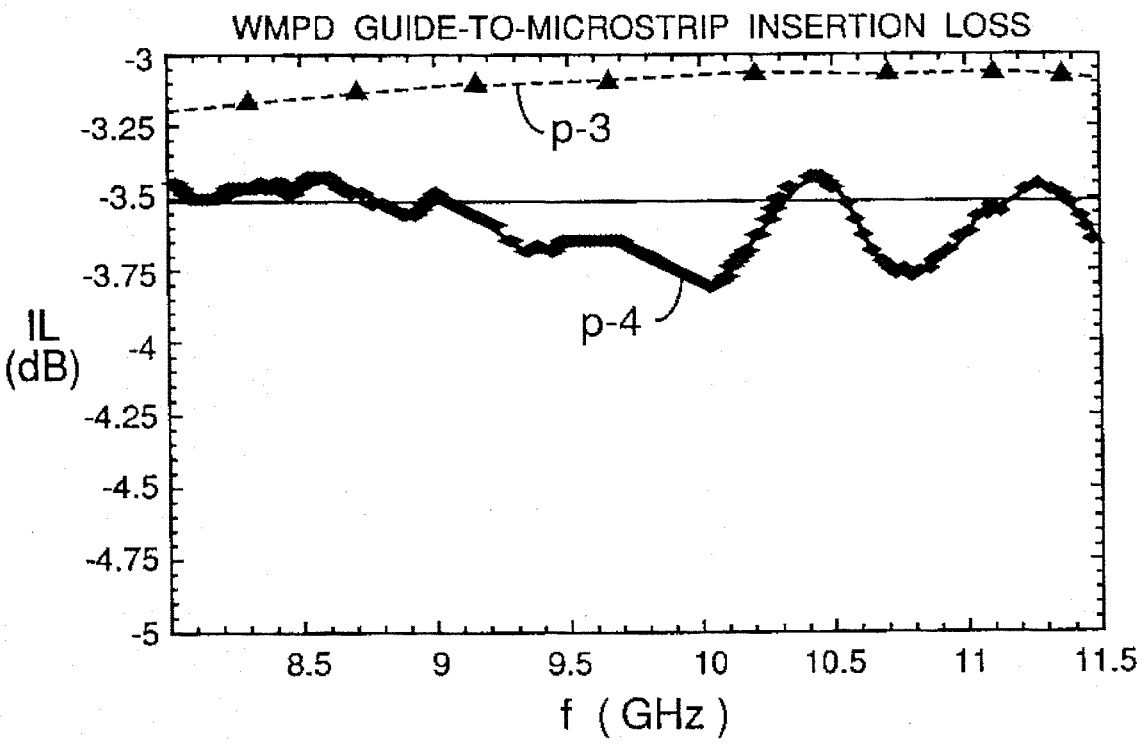
FIG. 4B is a graph of insertion loss (IL) in decibels (db) plotted against frequency (f) for the waveguide to microstripline transition of FIG. 1A.

FIG. 4B is a graph of insertion loss (IL) in decibels (db) plotted against frequency (f) for the waveguide to stripline transition of FIG. 1A. The plot p-3 provides theoretical results as compared with actual test result of plot p-4. The theoretical loss averages −3.2 db, while the actual averages −3.5 db. As in the case of FIG. 4A, the test results of FIG. 4B are for the X Band in the range from 8.2 to 12.4 GigaHerz, but similar results are obtainable for frequencies up to 100 GHz in discrete bands.

It will be appreciated that the test results for both FIGS. 4A and 4B are approximate, and that even closer agreement between actual and theoretical results is to be expected with more precise calibration.

Figure 5A:
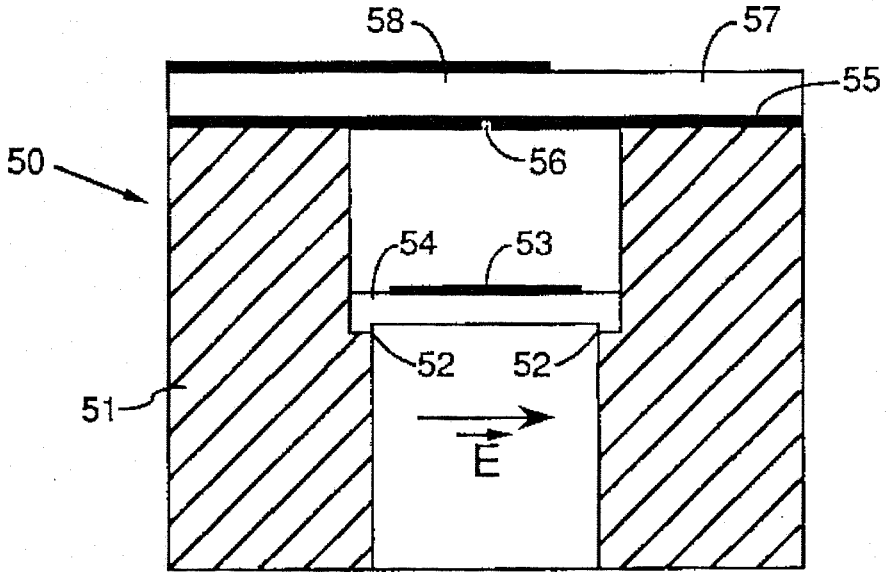
FIG. 5A PRIOR ART
FIG. 5A is a sectional view of a a waveguide to stripline transition in accordance with the prior art taken along the minor axis of a waveguide connected to the transition.
Figure 5B:
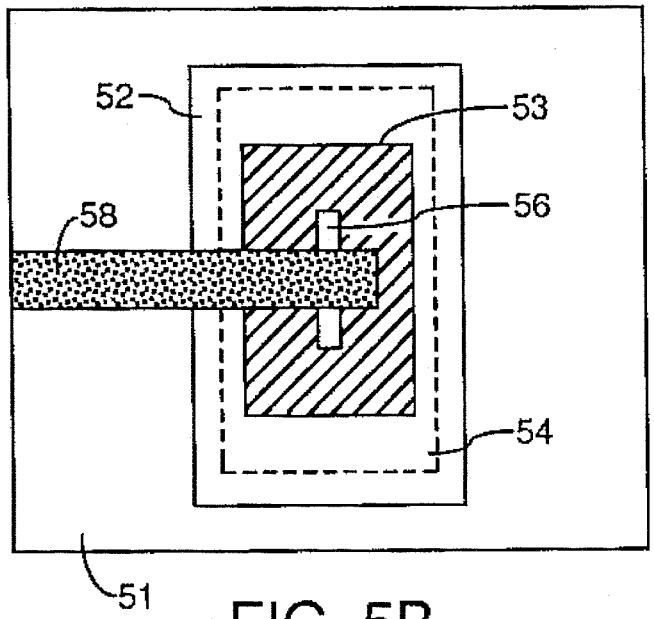
FIG. 5B PRIOR ART
FIG. 5B is an end view of the transition of FIG. 4A taken in the same relative direction as for the arrow B—B of FIG. 1A.

FIG. 5A is a sectional view of a a waveguide to stripline transition 50 in accordance with the prior art taken along the minor axis of a waveguide connected to the transition; and FIG. 5B is a partial end view, with various components omitted for clarity, of the transition of FIG. 5A taken in the same relative direction as for the arrow B—B of FIG. 1A.

The transition 50 is formed by a waveguide section 51, which has an internal step 52 for the positioning of a metallic patch 53 on a dielectric support 54 with respect to a transverse electric field E. The section 51 abuts a ground plane 55, with a coupling slot 56. The ground plane 55 is laminated to a dielectric 57, which support a stub length of open microstrip line 58. It will be appreciated that in FIG. 5B the dielectric 57 and the ground plane 55, with the exception of the slot 56, of FIG. 5A have been omitted for clarity.

The invention achieves superior performance with reduced complexity as compared with the prior art of FIGS. 5A and 5B It will be understood that the foregoing detailed description is illustrative only, and that various modifications and adaptation of the invention may be made without departing from the spirit and scope of the invention as defined in the appended claims.

What is claimed:

1. An electromagnetic wave conversion system for converting transverse electric waves into transverse electromagnetic current signals and which comprises:

a tapered waveguide section that receives and conducts said transverse electric waves in a large reception aperture and which has tapered walls that reduce as said transverse electric waves progress towards a small output aperture;

a ground plane which has a top surface that faces said small output aperture of said tapered waveguide section, said ground plane having a ground plane aperture that faces the small output aperture of the tapered waveguide section;

a microstrip line element which is fixed in proximity to the ground plane aperture in a direction that is transverse with respect to said tapered waveguide section, said microstrip line element being capable of being stimulated by transverse electric waves from said tapered waveguide section to conduct transverse electromagnetic current signals thereby, said microstrip line element radiating transverse electric waves back to said tapered waveguide section when receiving an externally generated transverse electromagnetic current signal; and a dielectric wedge that has a base affixed to the small output aperture of the tapered waveguide section to create thereby a narrow coupling aperture in the tapered waveguide section and thereby enhance power transfer between the microstrip line element and the tapered waveguide section.

2. An electromagnetic wave conversion system, as defined in claim 1, wherein said ground plane aperture has dimensions that are narrower than that of said small output aperture of said tapered waveguide section, and wherein said tapered walls of said tapered waveguide section terminate in said small output aperture to produce thereby a narrow output cross-section that reduces undesired reflections from said ground plane.

3. An electromagnetic wave conversion system, as defined in claim 1, including a coaxial fitting comprising a coaxial line with a center conductor which is electrically insulated from said ground plane and is connected to said microstrip line and wherein said coaxial line has an outer conductor electrically connected with said ground plane.

* * * * *